United States Patent [19]

Geuss

[11] Patent Number: 4,865,329

[45] Date of Patent: Sep. 12, 1989

[54] RETAINER MEANS FOR USE WITH A HIT SENSOR

[76] Inventor: Carlheinz Geuss, Thumbachstrasse 67, D-8484 Grafenwöhr, Fed. Rep. of Germany

[21] Appl. No.: 129,708

[22] Filed: Dec. 7, 1987

[30] Foreign Application Priority Data

Dec. 11, 1986 [DE] Fed. Rep. of Germany ... 8633233[U]

[51] Int. Cl.[4] ..... F41J 5/04

[52] U.S. Cl. ..... 273/372

[58] Field of Search ..... 273/372

[56] References Cited

U.S. PATENT DOCUMENTS 3,392,979 7/1968 Wilska ..... 273/372

3,479,032 11/1969 Ohlund et al. ..... 273/372

FOREIGN PATENT DOCUMENTS 1147507 6/1957 France ..... 273/372

*Primary Examiner*—Edward M. Coven

*Assistant Examiner*—Benjamin Layno

*Attorney, Agent, or Firm*—Ratner & Prestia

[57] ABSTRACT

A retainer for use with a hit sensor in firing exercises with targets that are interechangeably arranged at a remote distance is formed with a piezoelectric element which within a recess of a clamping device is embedded in a molded insulating material and which is connected by a resistor to a connector cable. The resistor forms a design part of a plug adaptor member by which the connector cable may be connected to connector pins of the piezoelectric element.

3 Claims, 2 Drawing Sheets

RETAINER MEANS FOR USE WITH A HIT SENSOR

FIELD OF THE INVENTION

This invention relates to a retainer means for use with a hit sensor in firing exercises with targets that are interchangeably arranged at a remote distance.

BACKGROUND ART

In the field of a military training program an infrared firing is usually exercised in which special targets are used that radiate a heat with a temperature higher than the temperature of the surrounding atmosphere for being recognizable also at night with any adequate nightsight view finder. In U.S. Ser. No. 792,978, Geuss, a target system for use in such infrared firing exercises is described as operating with targets that each comprise a wooden carrier material formed as a plate of uniform thickness which is covered on a front surface with a thin metallic layer of electrically conductive resistance material adapted for being heated by a heating current as supplied through a voltage step-down current step-up transformer.

When such a target system is being used it is highly desirable in having also the possibility of evaluating all of the shots that reach the target in the course of a firing exercise. Accordingly there are also in use already special hit sensors that comprise a piezoelectric element that forms a directly connected unit with an interference cable of such a length that when the piezoelectric element is fixed on the target its interconnection with a specific evaluation device for a corresponding remote control of the firing exercises may be secured. There are presently known different kinds of such evaluation devices which for a connection with such hit sensors necessitate the use of a connector cable with either two or with seven pins on a cable plug member which are to be inserted into a corresponding number of pin holes of two correspondingly different kinds of sensing inputs of such devices.

With such an arrangement in mind it becomes obvious that such hit sensors are quite often destroyed by straying shots that either reach the piezoelectric element or much more frequently its connector cable. It is therefore necessary to store at the exercise site a rather large number of such hit sensors of both kinds for allowing an immediate exchange whenever such a hit sensor has been destroyed during the course of a firing exercise. Since particularly the piezoelectric element forms a rather expensive part of such hit sensors such a frequent exchange is of course very costly also under the viewpoint that even with a damage only of the connector cable it no longer is possible to repeatedly use the piezoelectric element.

This invention deals with the object of providing a hit sensor which with the use of any suitably designed retainer means will allow a repeated use of the piezoelectric element as long as the same has not been directly damaged during the course of a firing exercise.

This object of the present invention is accomplished by a retainer means which includes a clamping device adapted for being fixed to a target and having a recess in which a piezoelectric element for sensing each shot at the target is arranged as embedded in a molded insulating material such as preferably a thermosetting material. The piezoelectric element is connected by means of a resistor that is arranged outside of the recess to a connector cable which may be of either of the two kinds with accordingly either two or seven pins on a cable plug member so that with the provision of cables having at their end opposite to this cable plug member a plug adaptor member that incorporates the resistor with a cable specific resistivity it then will be possible to connect the different kinds of cables without any problems with the piezoelectric element when the same according to a specific feature of the invention is provided with fixedly interconnected connector pins for its connection with the plug adaptor member of the connector cables.

DESCRIPTION OF THE INVENTION

Figure 1:
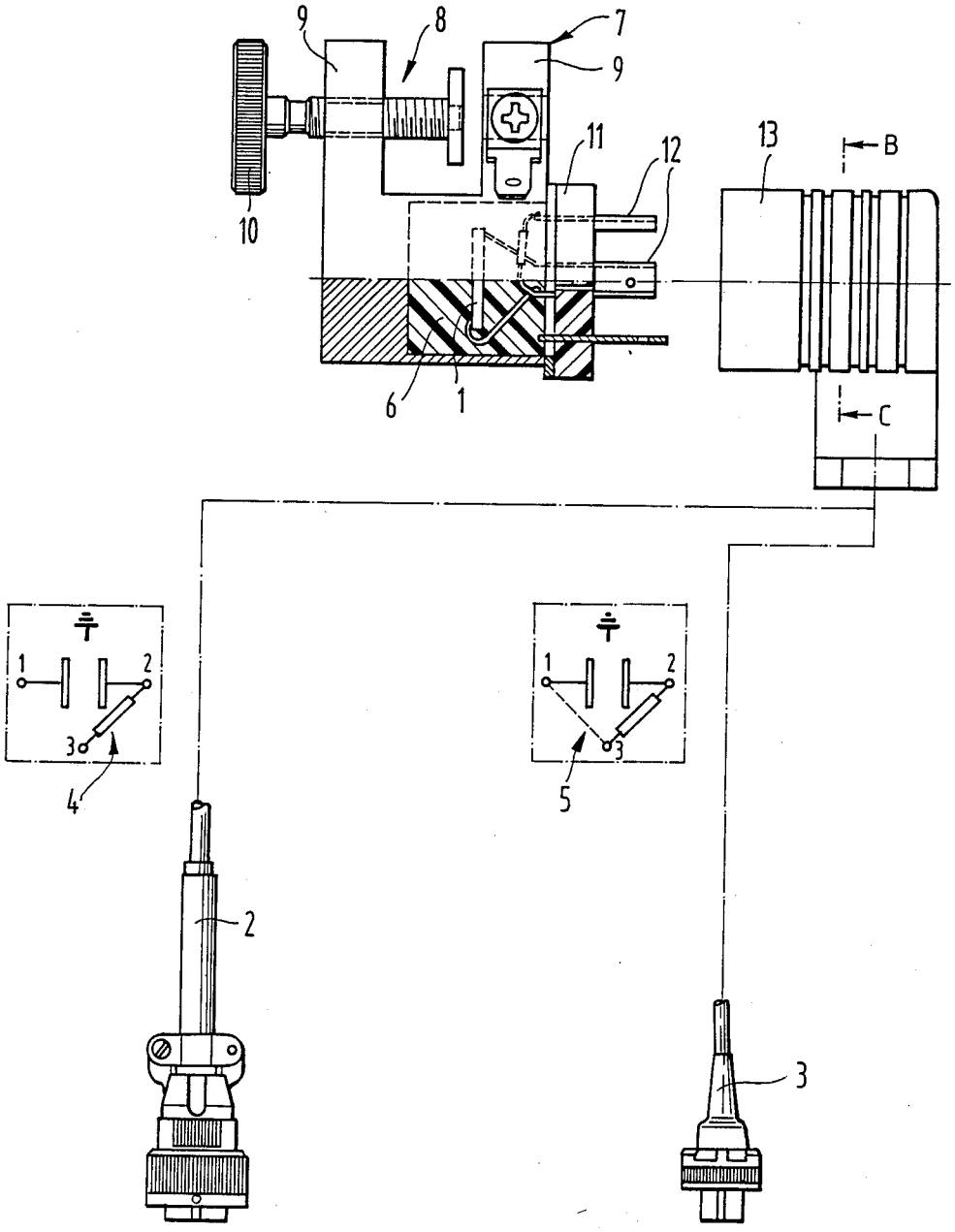
FIG. 1 is a schematic representation, partwise in section, of the hit sensor according to a preferred embodiment of the invention.
Figure 2:
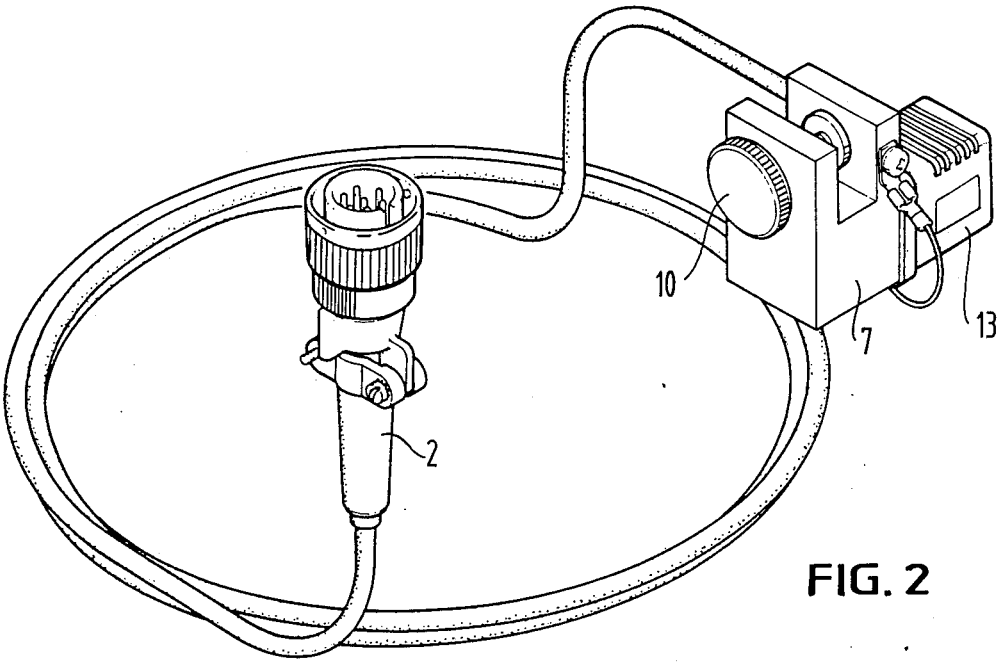
FIGS. 2 and 3 are perspective views of the inventive hit sensor with the two different connector cables as also schematically shown in FIG. 1.
Figure 3:
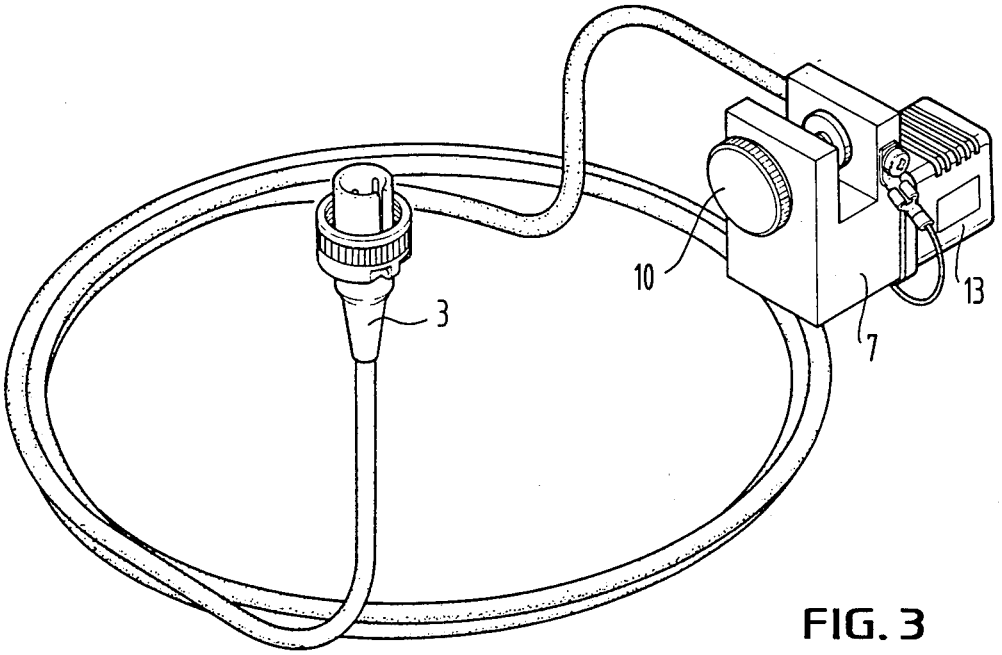

FIG. 1 illustrates partwise in section and partwise more schematical the entirety of a preferred embodiment of the inventive hit sensor which comprises in the first place the piezoelectric element 1 which by means of an interconnected cable may be connected to a device that evaluates electronically each shot which during a military firing program is fired against a target that is interchangeably arranged at a remote distance as for example described in more detail in U.S. Ser. No. 792,978. The presently used evaluation devices are provided with two different kinds of sensing inputs namely either with an input having seven pin holes or with an input having only two pin holes for a cable plug member that correspondingly must be provided with either seven or only two pins. FIGS. 1 to 3 therefore show a connector cable 2 having a conventionally designed cable plug member with seven pins and a connector cable 3 having a cable plug member with only two pins at the one cable end whereas the opposite cable end is provided with a plug adaptor member 13 which in the cross-sectional plane B-C is provided with either a resistor 4 or a resistor 5 of the correspondingly different resistivities with which these two kinds of connector cables are conventionally provided. As can be derived from the representation in FIG. 1 a different resistivity of the resistor 5 which is used for the plug adaptor member 13 of the connector cable 3 is accordingly obtained by means of a bridge connection between the electrical connecting points "1" and "3" which on the other side is not present in the resistor 4 of the plug adaptor member for the connector cable 2.

The piezoelectric element 1 is arranged inside of a recess 6 which is formed in a web portion of a substantially U-shaped holding clamp 7 forming a clamping device by means of which the hit sensor may be fixedly retained on a target. The holding clamp 7 further comprises two spaced apart leg portions 9 providing an interspace 8 the width of which is somewhat larger than the plate thickness of the targets that are used for exercising a military firing program. For fixing the holding clamp to an edge portion of a target there is further provided a clamping screw 10 on the one leg portion 9 which when turned projects into the interspace 8 between the two leg portions of the holding clamp.

The recess 6 in the web portion of the holding clamp 7 is closed with a connector member 11 which is provided with four connector pins 12 over which each plug adaptor member 13 of either the connector cable 2 or the connector cable 3 may be slipped with correspondingly provided pin holes to thereby obtain an electrical interconnection in a manner known to any skilled person. The connector pins 12 are connected with their opposite ends to the piezoelectric element 1 so that the same forms a design element of the connector member 11. FIG. 1 further shows that the piezoelectric element 1 is embedded in a molded insulating material which completely fills the recess 6 in the web portion of the holding clamp 7 so that with this embedded arrangement the piezoelectric element 1 as well as also the connector member 11 and its connecting pins 12 will be rigidly held on the holding clamp 7. The molded insulating material in which the piezoelectric element 1 is embedded could conveniently be a thermosetting material such a for example an epoxy resin and hardener mixture with which the recess 6 may be filled up prior to its covering with the connector member 11 so that when this mixture has been hardened this rigid arrangement of the piezoelectric element 1 and the connector member 11 on the molding clamp will then automatically be obtained. Since the resistor by means of which the piezoelectric element 1 must be connected to either the connector cable 2 or the connector cable 3 depending upon the kind of a sensing inlet of the device used for evaluating each shot at the target is provided outside of the recess 6 of the holding clamp 7 and is further incorporated as a cable specific resistor in the plug adaptor member 13 it accordingly is possible to repeatedly use the piezoelectric element even when the connector cable has been damaged so that it has to be exchanged for a continued use of a hit sensor of this kind. With the piezoelectric element 1 being embedded in the molded insulating material filling the recess 6 of the holding clamp 7 the same now forms a design unit with the piezoelectric element 1 and also with the connector member 11 and its connecting pins 12 which instead of forming a part of the connector member 11 could of course also be directly anchored in the molded insulating material in which the piezoelectric element and its connection with the connector pins is embedded as shown in FIG. 1 for the preferred embodiment of the inventive hit sensor.

What is claimed is:

1. A retainer means for use with a hit sensor in firing exercises with targets that are interchangeably arranged at a remote distance, the retainer means including a clamping device adapted for being fixed to a target and having a recess in which a piezoelectric element for sensing each shot at the target is arranged as embedded in a molded insulating material, the piezoelectric element being connected by means of a resistor that is arranged outside of said recess to a connector cable which serves a connection of the hit sensor with a device evaluating each shot at the target, said piezoelectric element being fixedly connected to connector pins for its connection with said resistor and further with said connector cable, said resistor being received in a plug adaptor member of said connector cable, said plug adaptor member being provided for a connection with said connector pins of said piezoelectric element.

2. A retainer means according to claim 1, wherein said connector cable is an interference protected cable with either two pins or with seven pins on a cable plug member at a cable end opposite to the cable end which is provided with said plug adaptor member, said plug adaptor member being provided with a correspondingly different resistivity for either of the two different kinds of connector cables.

3. A retainer means for use with a hit sensor in firing exercises with targets that are interchangeably arranged at a remote distance, the retainer means including a clamping device adapted for being fixed to a target and having a recess in which a piezoelectric element for sensing each shot at the target is arranged as embedded in a molded insulating material, the piezoelectric element being connected by means of a resistor that is arranged outside of said recess to a connector cable which serves a connection of the hit sensor with a device evaluating each shot at the target, said piezoelectric element being fixedly connected to connector pins for its connection with said resistor and further with said connector cable, said connector pins being arranged on a connector member that is provided for closing said recess after its filling with a thermosetting material forming said molded insulating material.

* * * * *